US010828215B2

(12) United States Patent
Guhel et al.

(10) Patent No.: US 10,828,215 B2
(45) Date of Patent: Nov. 10, 2020

(54) SYSTEM AND HANDLING METHOD TO FACILITATE THE MAINTENANCE OF A BED UNIT, IN PARTICULAR A HEALTHCARE BED

(71) Applicants: UNIVERSITE DE CAEN, Caen (FR); CENTRE HOSPITALIER PUBLIC DU COTENIN, Octeville (FR)

(72) Inventors: Yannick Guhel, Cherbourg (FR); Jean-Pierre Guillerm, Tourlaville (FR); Mickaël Besnard, Le Theil (FR)

(73) Assignees: UNIVERSITE DE CAEN, Caen (FR); CENTRE HOSPITALIER PUBLIC DU COTENTIN, Octeville (FR)

( * ) Notice: Subject to any disclaimer, the term of this patent is extended or adjusted under 35 U.S.C. 154(b) by 416 days.

(21) Appl. No.: 15/770,406

(22) PCT Filed: Oct. 19, 2016

(86) PCT No.: PCT/FR2016/052697
§ 371 (c)(1),
(2) Date: Apr. 23, 2018

(87) PCT Pub. No.: WO2017/068280
PCT Pub. Date: Apr. 27, 2017

(65) Prior Publication Data

US 2018/0311096 A1 Nov. 1, 2018

(30) Foreign Application Priority Data

Oct. 23, 2015 (FR) ..... 15 60160

(51) Int. Cl.
*B66F 7/14* (2006.01)
*A61G 7/08* (2006.01)
(Continued)

(52) U.S. Cl.
CPC ..... *A61G 7/08* (2013.01); *B66F 7/22* (2013.01); *A61G 5/006* (2013.01)

(58) Field of Classification Search
CPC ..... B66F 1/00; B66F 3/00; B66F 5/00; B66F 7/00; B66F 7/10; B66F 7/08; B66F 9/00; A16G 7/015; A16G 7/16; A16G 7/008
See application file for complete search history.

(56) References Cited

U.S. PATENT DOCUMENTS 3,876,024 A * 4/1975 Shieman ..... A61G 7/08 180/19.1
4,239,196 A * 12/1980 Hanger ..... B25H 1/0007 269/17
(Continued)

FOREIGN PATENT DOCUMENTS

DE 29 32 854 2/1981
FR 2 956 653 8/2011
(Continued)

OTHER PUBLICATIONS

International Search Report, PCT/FR2016/052697, dated Feb. 15, 2017.

*Primary Examiner* — Lee D Wilson
(74) *Attorney, Agent, or Firm* — Nixon & Vanderhye

(57) ABSTRACT

Disclosed is a handling system that makes it possible to place a wheeled sleeping unit, particularly a hospital bed, in a high position for a maintenance operation. The system includes a supporting device that is slidably mounted along a guide assembly and is provided with a receiving assembly that is hinged onto one or more vertical slidable portions of the device that are adjacent to a raising area. A sleeping unit can be placed in the area, above a lifting portion defined by the receiving assembly, and a longitudinal side of the unit can be positioned against an abutment surface of the assembly. The receiving assembly includes a holding element that
(Continued)

fits into the top of the unit so as to lock the positioning of the unit in the receiving assembly, which makes it possible to change the orientation of the unit after a raising phase.

20 Claims, 5 Drawing Sheets

(51) Int. Cl.
*B66F 7/22* (2006.01)
*A61G 5/00* (2006.01)

(56) References Cited

U.S. PATENT DOCUMENTS

| | | | | |
|---|---|---|---|---|
| 7,448,606 | B1 * | 11/2008 | Johnson | B05B 13/0285 269/16 |
| 8,596,627 | B2 * | 12/2013 | Lands | B25H 1/0007 269/57 |
| 2018/0311096 | A1 * | 11/2018 | Guhel | B66F 7/22 |
| 2020/0230001 | A1 * | 7/2020 | Heil | A61G 7/015 |

FOREIGN PATENT DOCUMENTS

| | | |
|---|---|---|
| GB | 786302 | 11/1957 |
| GB | 2 428 661 | 2/2007 |

* cited by examiner

SYSTEM AND HANDLING METHOD TO FACILITATE THE MAINTENANCE OF A BED UNIT, IN PARTICULAR A HEALTHCARE BED

TECHNICAL FIELD OF THE INVENTION

The present invention relates to handling facilities that facilitate interventions on the underside of a piece of furniture such as a bed or a stretcher, particularly in the hospital field. The invention relates more particularly to a system for handling rolling bed units and a method for positioning a rolling bed unit.

BACKGROUND OF THE INVENTION

In the hospital environment, so-called "medicalized" beds that can be moved using casters are widespread. These beds often have a metal frame, the bed base of which is articulated and can be operated through an electrical device, including using a remote control or any other appropriate interface. An upper frame that can move relative to a lower frame can also be provided. The beds or other comparable bed units have two longer sides defined by longitudinal edges and the casters are placed at opposite ends of the bed. With a complex mechanism, this type of bed must be serviced and requires maintenance over time. Casters may also need to be serviced/repaired. Since a healthcare bed is bulky and of a substantial weight (sometimes exceeding 200 kg), it would be costly to return this material to the manufacturer, and maintenance must be done on site. To carry out this maintenance, the technician must generally intervene on the parts of the mechanism which are mainly positioned under the bed base.

Bed lifting systems have been proposed, for example in GB 2428661 or FR 2956653, which prevent the user to manually turn the bed over. Some arms must be firmly attached to end portions of the bed before starting to lift it. After the phase in which the opposite ends of the bed have been attached, it can be lifted. These systems also provide for a tilting maneuver to turn the bed or to position it vertically.

A disadvantage with this type of system is that each of the arms must be firmly attached to the end portions of the bed before starting to lift the bed. This operation requires a certain degree of precaution and forces the technician to bend down.

Fastening the arms can be a tedious operation and a defect at this stage can cause the bed to fall down. It is also understood that the weight of the lifted bed is generally limited with this kind of solution, so that for example ranges of beds for obese people and equipped with certain optional features are excluded (for information purposes, beds XXL/140 cm have a base frame which weighs well over 110 kg, the mattress and accessories typically representing an additional load of around 50 kg).

The attachment means can also cause degradations of elements of the bed which are in contact with the arms and fasteners, due to the rotational movement (with torsional forces). Moreover, such solutions require the use of two motorized elements, distributed over two guiding columns, to actuate the lifting of a pair of arms. This can result in torsional problems for the bed structure.

GENERAL DESCRIPTION OF THE INVENTION

There is therefore a need to make the handling operation faster while providing a high level of security. The purpose of the present invention is therefore to overcome all or part of the aforementioned drawbacks by proposing an object handling system that can easily lift and modify the orientation of a rolling bed unit, such as for example a bed of hospital or stretcher.

For this purpose, it is proposed according to the invention a system for handling rolling bed units, in particular beds or stretchers, the system comprising:

a support device, movable by lifting to lift a bed unit, the support device comprising two sliding portions or ends, two guiding portions separated from one another by a lifting zone and vertically guiding a displacement of the sliding ends of the support device, and first driving means for linearly moving at least one sliding end of the support device and allowing lifting of the support device, wherein the support device comprises:

- a lifting portion, preferably formed by a fork, which extends transversely with respect to the two guiding portions in a loading configuration of a bed unit,
- retaining means integral with the lifting portion and forming an abutment surface intended to be placed in contact with a determined longitudinal side or edge of the bed unit, the retaining means and the lifting portion defining a receiving assembly, and
- at least one holding element adjustable in position so as to move towards or away from the lifting portion, the receiving assembly being pivotally mounted between the two sliding ends about a substantially horizontal axis of rotation, whereby a bed unit maintenance configuration is obtained in which the bed unit is raised and maintained; by the support device while having a modified orientation as compared to the loading configuration.

Thanks to this arrangement, positioning the rolling bed unit is simplified. It is sufficient to place a longitudinal edge of this unit against the abutment surface when placing the bed unit in the lifting zone. The lifting portion is then placed under the bed unit, typically between the wheels, so that the technician does not need to adjust fasteners at opposite ends of the bed. The holding element, typically located above the level of the bed unit, makes it possible to lock the relative position of the bed unit with respect to the receiving assembly. The downward movement of the holding element may optionally be actuated by a positioning control and the final contact position can be obtained by using one or more sensors. It is understood that this holding element allows, in association with the lifting portion, to sandwich the bed unit (as if caught in a vise).

As compared to solutions where the bed unit is lifted at its two opposite ends, it is here also possible to simplify the means required for lifting by connecting a single support device (formed in one piece) to the two guiding portions. In practice, the system offers great flexibility, so that all models of healthcare beds can be maintained (even beds up to about 400 kg for example) without the risk of altering the structure of the bed or degrading bed finishes.

According to a particular feature, the system comprises second driving means for rotating the receiving assembly about the axis of rotation which passes through the two sliding ends, after the support device loaded with the bed unit has been lifted, so as to orient the determined longitudinal edge downwards in the bed unit maintenance configuration. For example, these second driving means are configured to rotate the receiving assembly up to a maximum of a quarter turn, the rotation angle being adjustable by a human-machine interface.

In various embodiments of the handling system according to the invention, one or more of the following features may also be used:

- the lifting portion is connected to the retaining means at only one side thereof which is the rear side.
- the linear displacement of the support device is controlled by a human-machine interface which makes it possible to adjust the elevation height of the bed unit.
- the receiving assembly is pivoted by two connection shafts connecting with respectively one and the other of the two sliding portions or ends of the support device, the second driving means comprising a single rotary drive member for defining a first drive shaft among the two connection shafts, the second shaft of the two connection shafts being a following shaft.
- the rotation angle of the receiving assembly is adjustable by means of a human-machine interface and can reach a maximum of approximately 85 or 90° (it is understood that the technician can carry out the maintenance without having to be under the bed unit).
- at least one of the sliding ends has three or four faces shaped to at least partially surround a column that belongs to the guiding portion.
- the receiving assembly is provided with two flanks which are each rotatably connected to the sliding ends.
- the lifting portion extends, in the loading configuration, into a central sub-zone of the lifting zone, at a distance from the two guiding portions, whereby casters of a bed unit can be distributed on both sides of the lifting portion (it is understood that the lifting portion, which in practice extends under a center of gravity of the bed unit in the loading configuration, may be sufficient to achieve the uprising by itself).
- the lifting portion, connected on one single side to the retaining means, comprises two spaced rigid members whose spacing can be adjusted and each provided with a contact surface on the top, such contact surface being made of flexible and/or deformable material (for example elastomer, natural rubber or suitable polymer, which advantageously prevents damaging the lower surfaces of a bed unit).
- the lifting portion comprises a fork provided with at least two teeth each elongated from a proximal end to an distal end with respect to the abutment surface, and which preferably extend in a direction perpendicular to the axis of rotation.
- the guiding portions are defined by columns which are fixed and secured to a base.
- a substantially flat base (the base of the system being able to form one or more rolling tracks) is formed between the two guiding portions, the lifting portion extending to a height of less than or equal to 25 cm, and preferably less than 20 cm from the flat base, in a lowered state of the support device which corresponds to the loading configuration.
- the receiving assembly is bent and is in one piece (the receiving assembly is thus robust and may have a swing shape that facilitates the approach and reception phase of the bed unit, while correctly positioning it above the lifting portion; this configuration allows adaptation to a very wide range of medical beds with high weights which may exceed 400 kg while keeping a margin of safety).
- the lifting portion is substantially flat and the holding element comprises a clamping member which, in the loading configuration, is connected from above (for example by a bracket) to the retaining means (part of the back/back of the receiving assembly).
- the clamping member is movable in a direction perpendicular to the lifting portion and held at a distance from the lifting portion, which allows an outer frame of the bed unit to be inserted from a side opposite the retaining means in a clamping zone delimited between the lifting portion and the clamping element.
- the position of the clamping member can be adjusted by screwing in a direction parallel to the lifting direction. There is provided, in a non limiting manner, a screw system that can be manual or electrical. The latter can be positioned at the rear with respect to the bed unit (when the clamping is actuated manually by a crank or similar member, it is understood that the clamping member is connected to the receiving assembly at an accessible side, typically at the back).
- the position of the clamping member can be adjusted automatically by using at least one sensor, for example a contact sensor.
- the handling system further comprises at least one sensor, for example a contact sensor, for detecting a contact position of a bed unit against the abutment surface, the sensor being able to deliver a corresponding detection information.
- a control unit of the system is configured to start a lifting of the support device according to the detection information delivered by the sensor (this makes it possible to ensure correct positioning of the bed unit and results in increased safety since there is no risk that the bed unit suddenly slips towards the abutment surface during rotation).

According to another feature, the two guiding portions are replaced by a guiding column which may be the only guiding column. In this case, the guiding column is adjacent to a lifting zone in which the bed unit can be lifted by the support device. Of course, the retaining means typically define the same determined side of the lifting zone, in the loading configuration, and the guiding column can then be formed on this determined side, preferably behind the retaining means which define the abutment surface.

The lifting portion may be designed and arranged to locate beneath a central zone of the bed unit (thus being typically positioned under the center of gravity of the bed unit, so that the lifting portion may be the only lifting portion in the system).

Preferably, the support device is slidably mounted on the guiding column by a sliding portion fixed to the guiding column and guided vertically along the guiding column. This sliding portion is moved linearly by first driving means which allow lifting the support device. The receiving assembly is thus pivotally mounted about a substantially horizontal axis of rotation defined by an articulated connection between the sliding portion and the receiving assembly (said connection being located forward of the guiding column to allow the rearward movement of the top of the receiving assembly), whereby the bed unit can also be lifted and maintained in a modified orientation by the support device.

The support device, attached to the single guiding column, is adapted to support the bed unit on its own, by engaging under a central zone of the bed unit, typically from a long side of the bed unit. The lifting portion of the support device is designed and arranged so that the casters of a bed unit are arranged on either side of the lifting portion.

According to one feature, the receiving assembly is rotated about the axis of rotation by second driving means which may optionally comprise at least one jack oriented transversely to the guiding column, wherein the axis rotation is maintained at a constant spacing from the guiding column which is typically fixed, regardless of the height level of the support device.

Furthermore, the invention also relates to a method for positioning a rolling bed unit, in particular a bed or a stretcher, for a maintenance/repair operation, to facilitate intervention of an operator (while minimizing the arduousness of this intervention), this method comprising the steps consisting essentially of:

- placing a bed unit in a lifting zone, above a lifting portion that is part of a support device, the lifting zone being located between two guiding portions;
- engaging a determined longitudinal side or edge of the bed unit against a abutment surface integral with the lifting portion and extending transversely with respect to the lifting portion, so that the bed unit is received in a receiving assembly in a loading configuration;
- adjusting in position at least one holding element for holding the bed unit from above to obtain a locked relative position between the bed unit and the receiving assembly;
- lifting the bed unit with a linear displacement of the support device, guiding by means of the two guiding portions two sliding portions or ends of the support device; and
- beyond a predetermined elevation threshold, rotating the receiving assembly and the bed unit held in the locked position about a substantially horizontal axis of rotation by moving the abutment surface downwards until a bed unit maintenance configuration is obtained in which the bed unit is raised and held by the support device while having a modified orientation with respect to the loading configuration.

The method advantageously makes it possible to raise the medical beds and stretchers without exerting physical effort or critical manual adjustments for lifting. The receiving assembly may have a bottom (lifting portion), a holding element from above, and retaining means which for example form both a back (typically defined by a rear frame and forming the abutment surface) and a pair of flanks, so as to define a receiving housing for the bed unit. Access to this housing is achieved from the front of the receiving assembly, without obstruction since the bed unit feet provided with wheels allow positioning of the bed base above the lifting portion. After having placed the bed unit between the flanks and against the abutment surface, all that remains is to adjust the holding element (which can be automated), so that the technician no longer needs to move the bed unit.

BRIEF DESCRIPTION OF DRAWINGS

Other features and advantages of the invention will emerge during the following description of several of its embodiments, given by way of non-limiting examples, with reference to the accompanying drawings in which.

DESCRIPTION OF PREFERRED EMBODIMENTS OF THE INVENTION

In the different figures, the same references designate identical or similar elements.

Figure 1:
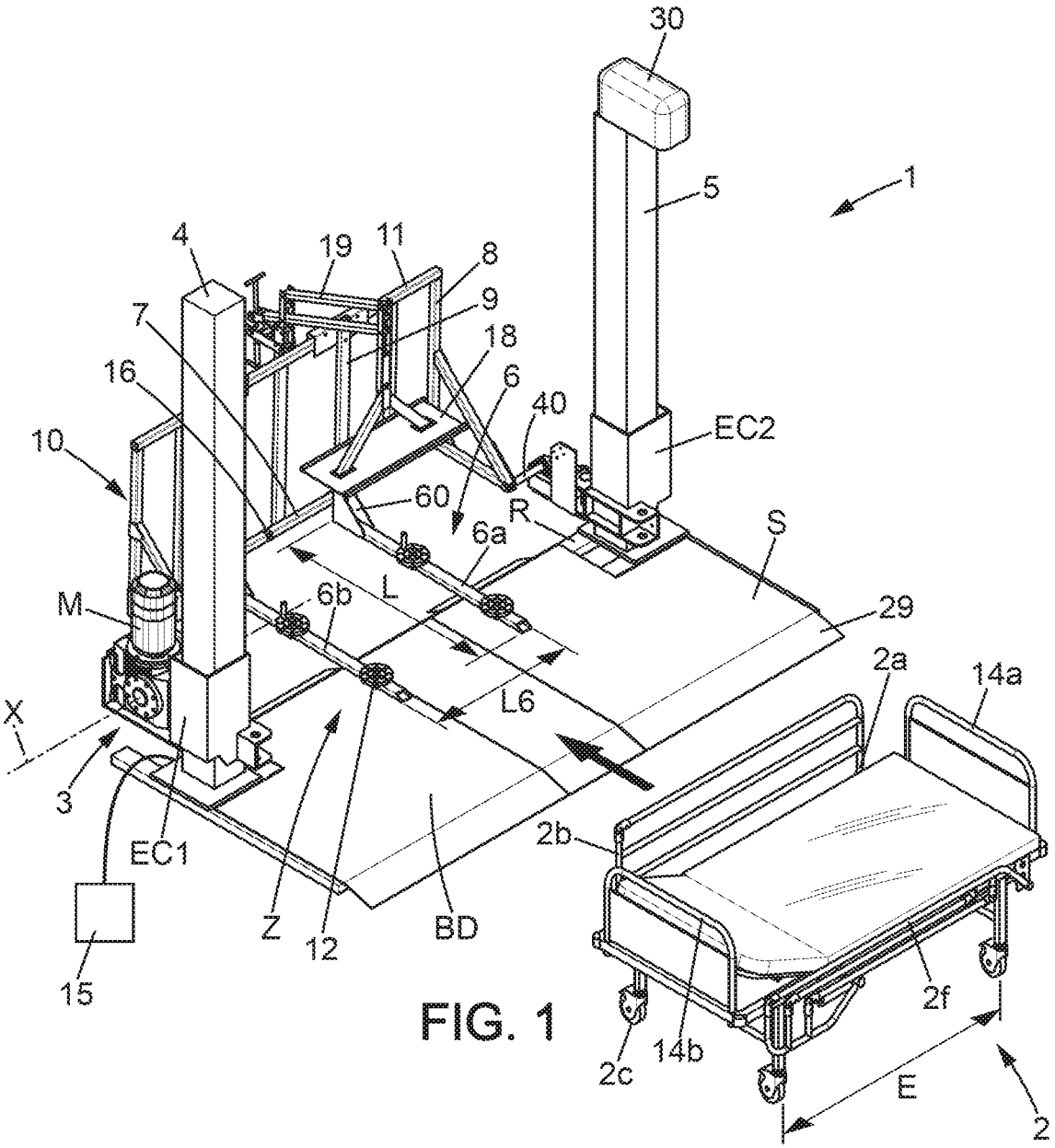
FIG. 1 is a perspective view illustrating a handling system according to a first preferred embodiment of the invention.
Figure 2:
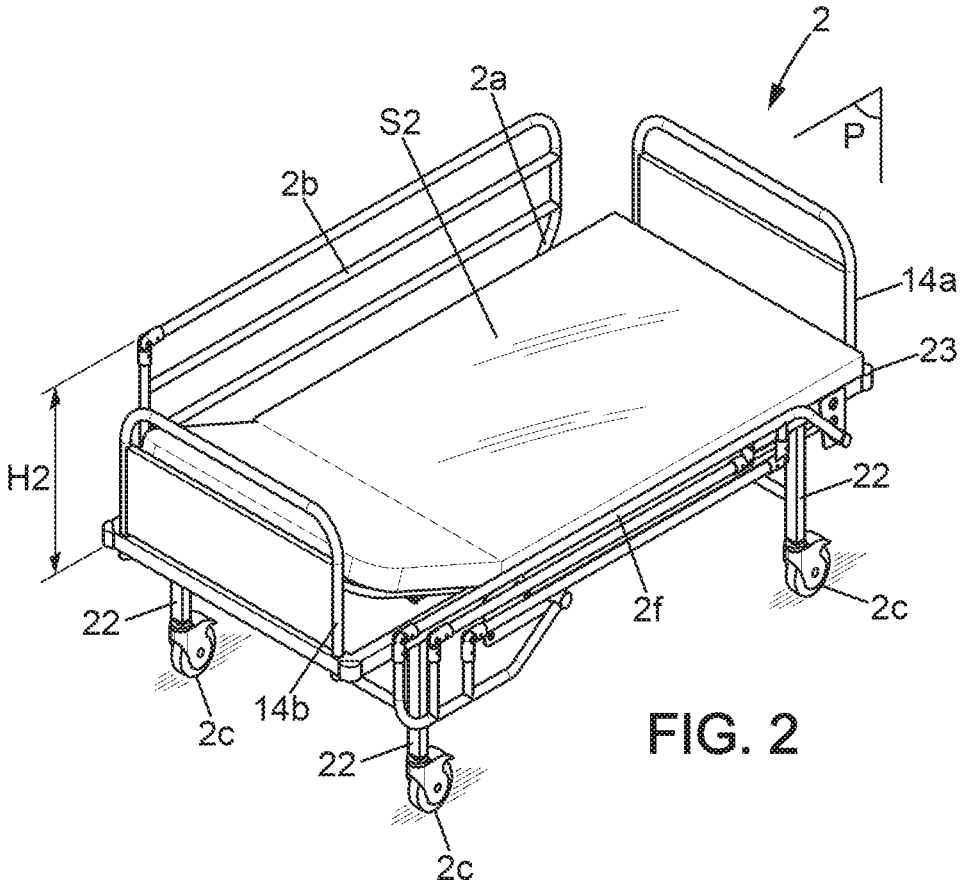
FIG. 2 shows a rolling bed unit that can be received on the support device of the system of FIG. 1.

Referring to FIGS. 1 and 2, the handling system 1 is designed to receive, lift and rotate a bed unit 2, for example a rolling unit such as a healthcare bed or a stretcher. The handling system 1 comprises a support device 3 which is mounted directly on two guiding portions 4, 5 separated from each other by a lifting zone Z. The support device 3 comprises:

- Two sliding portions or ends EC1, EC2, opposite to each other (arranged on either side of a lifting zone Z) and which are mounted integral with the respective guiding portions 4, 5,
- and a receiving assembly 10 which is articulated with respect to the two sliding ends EC1, EC2.

The receiving assembly 10 has a lifting portion 6, here formed by a fork, the length L of which being typically sufficient to allow it being placed under the bed unit. This length is for example greater than or equal to 120 cm, and preferably at least 140 cm or 160 cm. In the loading configuration, the support device 3 is in a lowest position, the sliding ends EC1 and EC2 being placed near a base of the parallel/vertical columns forming the guiding portions 4, 5. This configuration makes it possible to engage the bed unit 2 against an abutment surface 7 defined by the receiving assembly 10 and which extends transversely above a rear end of the lifting portion 6.

The bed unit 2, here in the form of a healthcare bed (FIG. 2), can be transported, by simply rolling it, to the lifting zone Z, and orienting it so as to first place a determined longitudinal edge 2*a* against the abutment surface 7 formed by the receiving assembly 10. In the nonlimiting example of FIG. 1, the abutment surface 7 is defined in particular by a frame 8 and by supporting members 9 which support members spaced apart from each other and belonging to the lifting portion 6, here the teeth of a fork. The abutment surface 7 can thus be formed on a substantially flat framework delimited by the frame 8 and extending perpendicularly to the lifting portion 6. More generally, any retaining means 8, 9 adapted to define such an abutment surface 7 can be used (an opaque plate can thus be used for example). The retaining means 8, 9 extend on the opposite side to the access for the bed unit 2. Preferably, the lifting portion 6 which extends as close as possible to the workshop floor of the workshop or to the base S of the system 1 is connected on one side to the retaining means 8, 9.

To facilitate positioning of the lifting portion 6 between the feet 22 (each provided with a caster 2*c*) of the bed unit 2, the support elements 9 can be slidably mounted along at least one attachment rail 11 which is part of the receiving assembly 10. The desired position of these support elements 9 is for example locked by removable fastening elements, with typically a clamping element. The spacing E in length between the legs 22 or similar base elements is typically greater than 100 cm, so that the lifting portion may have a width L6 typically lower but close to this spacing, this width L6 may for example be at less than half the total length of bed unit 2. The lifting portion 6 remains away from the end panels 14*a* (foot side) and 14*b* (head side) and these ends can therefore differ widely from one bed unit 2 to another, without this hindering the movements permitted by the handling system 1.

The mobility of the support elements 9 makes it possible to adjust the width L6 of the lifting portion 6 while preserving overall rigidity of the receiving assembly 10. It can be seen in FIG. 1 that the width L6 is less than the length L of the lifting portion 6, so that this portion 6 of the receiving assembly 10 is longer than wide.

Optionally, the lifting portion 6 has two spaced rigid members 6*a*, 6*b*, for example two teeth to form a fork, each provided on the top with a less rigid coating. Thus, for example with the aid of skids directly mounted on these members 6*a*, 6*b*, contact surfaces 12 made of flexible and/or deformable material (for example elastomer, natural rubber or suitable polymer) are defined so as to get in contact with the underside of the bed unit 2. This makes it possible to avoid degrading lower surfaces of the bed unit 2.

Figure 3:
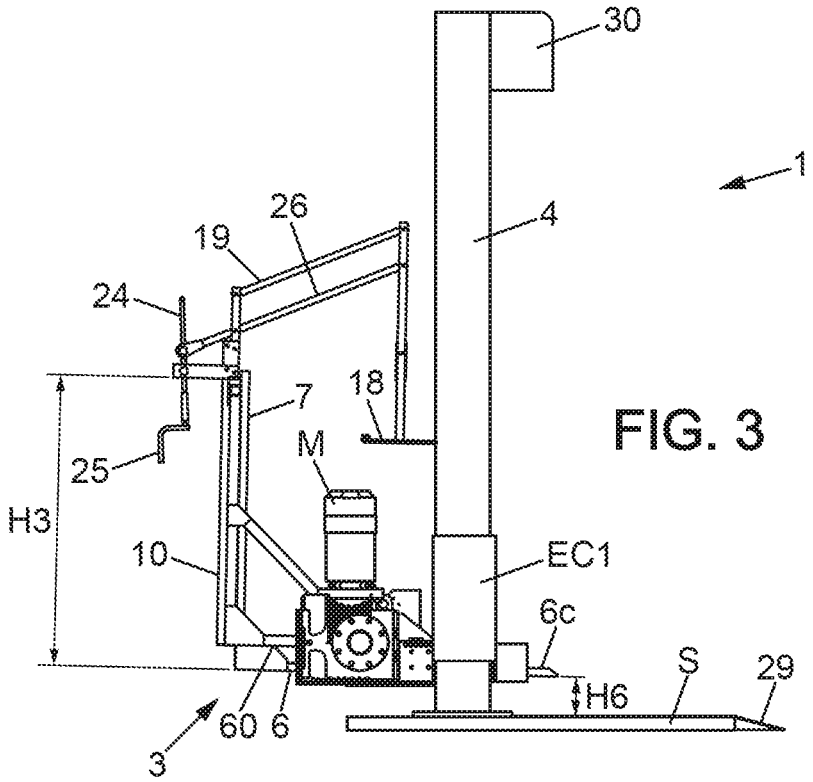
FIG. 3 is a side view illustrating the system of FIG. 1, in a configuration that allows loading on a support device provided with a receiving assembly.

As clearly visible in FIG. 1, the frame of the handling system 1 can be secured to the ground, in particular by screws penetrating in the ground. This makes it possible to withstand heavy loads. Of course, the system may also be optionally partially (at least) secured to any other substrate of the building that has a resistance comparable to that of a floor. The base S, here in a substantially rectangular tray shape, may have long sides, at least one of which being provided with a ramp 29 for sliding or rolling a bed unit 2 in the vicinity of the lifting zone Z, from the ground to the top surface of the base S. The base or rolling track BD is horizontal at least in the lifting zone Z. In FIG. 3, in the lowered state of the support device 3, it can be seen that with respect to the plane base formed between the two guiding portions 4, 5, the lifting portion 6 is slightly raised, and extends for example at a height H6 less than or equal to 25 cm, and preferably less than 20 cm with respect to this flat base.

The base S is an optional feature which has the particular advantage of allowing a fine adjustment of the positioning of the two guiding portions 4, 5. By way of non-limiting example, variants are possible without base S. Thus in the embodiment of FIG. 5, the base S can be deleted. Using a single guiding column 4' allows an embodiment without base S. In embodiments having two guiding portions 4, 5, it is also possible to provide columns with a respective motor per column while removing the base S.

Figure 6:
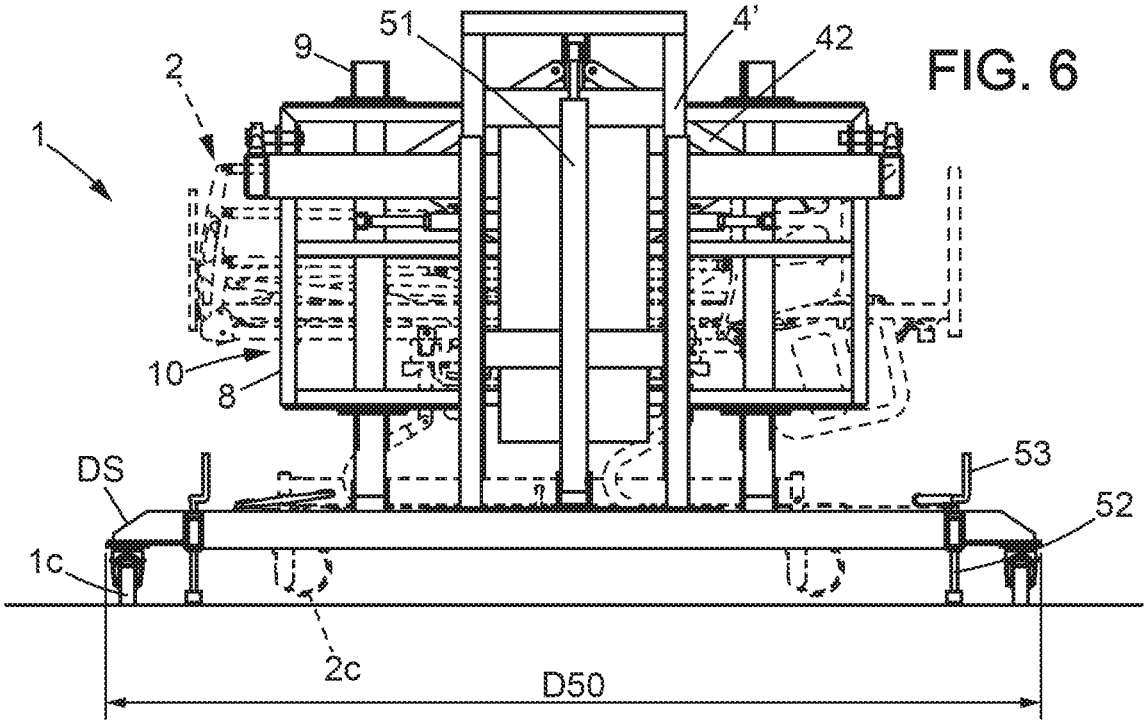
FIG. 6 is a rear view of a handling system according to a third preferred embodiment of the invention, with a guiding column placed behind the receiving assembly as in the case of FIG. 5.

Optionally, the handling system 1 can be made mobile, for example by having rollers feet 1*c*, as shown in FIG. 6 in the embodiment with a single guiding column 4'. A stationary position can be maintained by a stabilizer DS provided with complementary footing 52, which is adjustable in height and provides vertical thrust against the ground or any suitable support surface. Threaded rods or rods provided with locking elements can be used to adjust the height of the position of the complementary legs 52, which here end with a pad 54 having a flat surface for contact with the ground. Complementary feet 52 are mounted vertically movable in a generally horizontal structure, here a "U" structure, which at least partially delimits a lifting zone Z.

Lowering the pads 54 can be performed manually by cranks 53 or other gripping members. Of course, the structure equipped with casters 1*c* can equip a handling system 1 which has several guiding columns 4, 5 preferably arranged on either side of the lifting zone Z, which makes it easier to move this system 1 (with the complementary legs 52 set in a high position).

The extension length D50 of the stabilizing device DS may be greater than 2 meters and here greater than the distance E in length between the legs 22 of the bed unit 2.

The elongated teeth forming the rigid members 6*a*, 6*b* of the fork each extend from a proximal end 60 (near the abutment surface 7) to an end 6*c* which is distal with respect to the abutment surface 7. These rigid members 6*a*, 6*b* thus pass through the passage defined between the two guiding portions 4, 5 and can be distributed on either side of a vertical median plane of the lifting zone Z (this virtual median plane extending at an equal distant from the two guiding portions 4, 5). As illustrated in FIGS. 1 and 3, the ramp 29 may extend upstream of this lifting zone Z, for example more than 50 cm upstream from the ends 6*c* of the lifting portion 6. It will be understood that the abutment surface 7 delimits the rear end of the lifting zone Z in these FIGS. 1 and 3.

Figure 4:
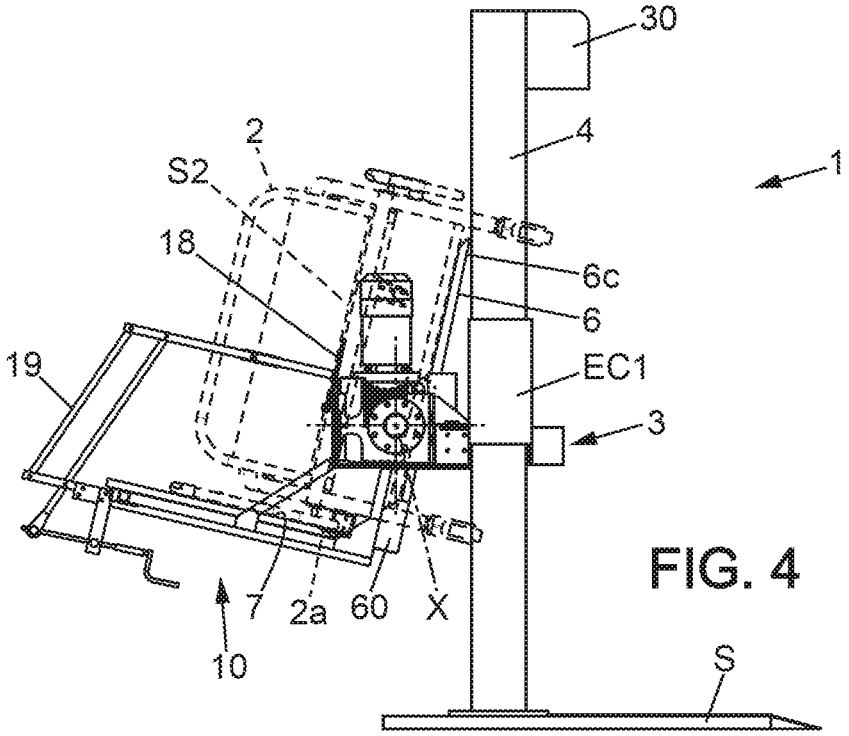
FIG. 4 is a view similar to FIG. 3, illustrating the handling system in a loaded elevation configuration, with a modified angular position of the receiving assembly to allow maintenance without the user having to place himself under the bed unit.

Referring to FIGS. 1 and 4, the support device 3 is movable by lifting to lift a rolling unit 2, and lifting guidance is permitted by means of wrapping surfaces formed around the guiding portions 4, 5 by the sliding portions or ends EC1, EC2. The mechanical drive to achieve this lifting is for example allowed by a motorized element 30 which is associated with one of the two sliding ends EC1, EC2. In this case, it is possible to associate with the sliding end EC1 or EC2 an electric or hydraulic jack (not shown). Alternatively, another lifting member of a kind known per se is used, for example a chain of a lifting mechanism associated with the guiding portion 5, so as to define a motor drive with guidance along this part of guidance 5. In the example shown, the motorized element 30 can drive a chain (not shown) which is housed in a housing defined by the guiding portion 5. Along the column forming the other guiding portion 4, the vertical sliding displacement is then a free movement (slave guide zone).

A rotational drive motor M, in connection with a control panel, a remote control or other human-machine interface, can also be provided on the side of one of the two sliding ends EC1, EC2, in order to rotate the receiving assembly 10 in a controlled manner. After lifting the support device 3 loaded with the bed unit 2, the receiving assembly 10 can be moved so that the determined longitudinal edge 2*a* is oriented downwards and thus a configuration for maintenance of the bed unit 2 can be obtained.

To enable the orientation of the receiving assembly 10 to be changed, each of the sliding ends EC1, EC2 may have a pivot with a common axis of rotation X which is horizontal. The receiving assembly 10 thus makes the connection between the end portions of the support device 3, by means of two aligned and opposite pivots (situated on either side of the bed unit 2 when the latter is positioned in the lifting zone Z). A connecting shaft is typically provided in each of the sliding ends EC1, EC2 to carry the receiving assembly 10 and its load. A connection shaft 40 may optionally be a following shaft, while the other connection shaft is a driving shaft.

The axis of rotation X here extends through the two sliding ends EC1, EC2. Two feet 22 of the bed unit 2 are typically placed between the abutment surface 7 and the axis of rotation X, so that this axis of rotation X is closer to a median plane P of the bed unit 2. The axis of rotation X may optionally be rearwardly arranged with respect to the passage defined between the two guiding portions 4, 5, with the motor M placed just behind a column forming the guiding portion 4. This limits the risk of direct shocks against system 1 driving parts when the bed unit 2 is being set up. In a pivotal configuration at about 80° or 90°, as illustrated in FIG. 4, the axis of rotation X may be located lower than the median plane P.

A control unit 15 of the system 1, connected in a manner known per se to the various (lifting and rotating) driving means, is provided for:

- starting a lifting of the support device 3 as soon as a loading configuration has been detected;
- allowing rotation only when a sufficient height level of the support device 3 has been reached; and
- optionally, further mounting the support device 3 according to a command on an HMI interface associated with the control unit 15.

The drive connection of the motor M makes it possible to rotate the receiving assembly 10 at most a quarter turn, the rotation angle being for example adjustable by means of a human-machine interface of the control unit 15.

The lifting cylinder, in particular if it is an electric cylinder, can advantageously be housed in a housing of the column or guiding portion 4. Such a jack can be a screw jack, irreversible, in particular actuated by an electric motor. With such an actuator it is possible to easily control and block the position of the sliding ends EC1, EC2, whatever the inclination of the receiving assembly 10, without requiring the mandatory presence of a brake. Whatever the rotational torque exerted on the pivots of the support device 3, the irreversibility of the screw makes it possible to prohibit the rotation of the receiving assembly around the axis of rotation X. As a safety measure, an additional brake is not excluded and can be provided.

The detection of a correct positioning of the bed unit 2 in the loading configuration is for example allowed by one or more sensors for detecting a contact position of the bed unit 2 against the abutment surface 7. It may be a contact sensor 16 provided to deliver a corresponding detection information.

Once the bed unit 2 is positioned parallel to the axis of rotation X and bears on the abutment surface 7, the technician can lower the holding element 18. Once the bed unit 2 is locked in position relative to the receiving assembly 10, it is permitted to actuate the movement of the receiving assembly 10 and then its 90° rotation with respect to its initial position, in a stable position with the bed unit 2 bearing axially against the abutment surface 7 or at any intermediate angular position between its initial position and the 90° tilted position.

To lower the bed unit 2, it is understood that the control unit 15 can also block the descent in the lowest position until the receiving assembly 10 is oriented as in the initial loading configuration. This descent is for example only permitted after returning to a substantially horizontal position of the lifting portion 6.

With reference to FIGS. 2 and 3, the height H3 of the receiving assembly 10 may be greater than the height H2 of the barrier 2*b* of the medical bed to be loaded or than a similar height as measured on the determined longitudinal edge 2*a*. Such a height H3, measured vertically in the loading configuration, is for example greater than 50 cm.

The receiving assembly 10 also incorporates at least one holding element 18 adjustable in position to move closer to or away from the lifting portion 6, provided to wedge and lock a horizontal initial position of the bed unit 2 before lifting. After rolling the bed unit 2 on the rolling track BD (here defined by the upper surface of the base S) and having placed the determined longitudinal side or edge 2*a* against the abutment surface 7, the position of the bed unit 2 can be locked by lowering the holding element 18 towards the lifting portion 6. The holding element 18 comprises for example a clamping member which, in the loading configuration, is connected from above to the retaining means 8, 9. This clamping member is movable in a direction perpendicular to the lifting portion 6 and held at a distance from the lifting portion 6, which allows a bed base 23 or equivalent frame of the bed unit 2 to be inserted from a side opposite to the retaining means 8, 9 in a clamping zone delimited between the lifting portion 6 and the clamp of the holding element 18.

A threaded rod 24 and an adjusting handle 25, associated with an articulated drive rod 26 here make it possible to move the clamping member. Although FIGS. 1 and 3-4 show a bracket 19 mounted at the rear of the frame 8 to place the clamping member in a position which is spaced from and parallel to the lifting portion 6, other configurations of the holding element 18 are of course possible. In particular, the displacement of the holding element 18 can be automated, using an actuator associated with a contact sensor or an equivalent sensor system.

The holding element 18 defines a lower contact surface which engages an upper surface S2 of the bed unit 2. This holding makes it possible, in particular during a return phase to the loading configuration (the return phase being a rotation that takes place after maintenance/repair), to prevent the return to the horizontal position of the bed unit 2 being accompanied by a relative displacement of all or part of the bed unit 2 in a direction away from the abutment surface 7. More generally, it is understood that the bed unit 2 can be made integral with the receiving assembly 10, both during ascending/descending translation movements and pivoting about the axis of rotation X.

With reference to FIGS. 1, 3 and 4, it can be seen that the use of a bent profile receiving assembly 10 allows retention of the bed unit 2 with an abutment surface 7 which can extend and/or stretch continuously over more than half the length of the bed unit 2. The lifting of the bed unit 2 results from the linear displacement of the support device 3, guiding vertically the two sliding ends EC1, EC2 of the support device 3 by means of the two guiding portions 4, 5. Below a predetermined elevation threshold, the control unit 15 does not allow the receiving assembly to rotate. Indeed, when the axis of rotation X is not further back than the abutment surface 7, sufficient clearance is required below the lifting portion 6 to lower the proximal end 60. This threshold can be not-limitingly comprised between 50 or 60 and 120 cm (height of the axis of rotation X relative to the flat base defined by the base S). Beyond this predetermined elevation threshold, the handling system 1 makes it possible to rotate around the axis of rotation X the receiving assembly 10 together with the bed unit 2 held in its locked position.

In a healthcare bed maintenance configuration as illustrated in FIG. 4, only a long side 2*f* of the bed, opposite to the determined longitudinal edge 2*a*, is not engaged either against the receiving assembly 10 or against the holding element 18. More generally, the orientation modification of the bed unit 2, which is advantageous for easy intervention by the technician, is obtained without risk of damage due to frictional twisting or sliding.

Figure 5:
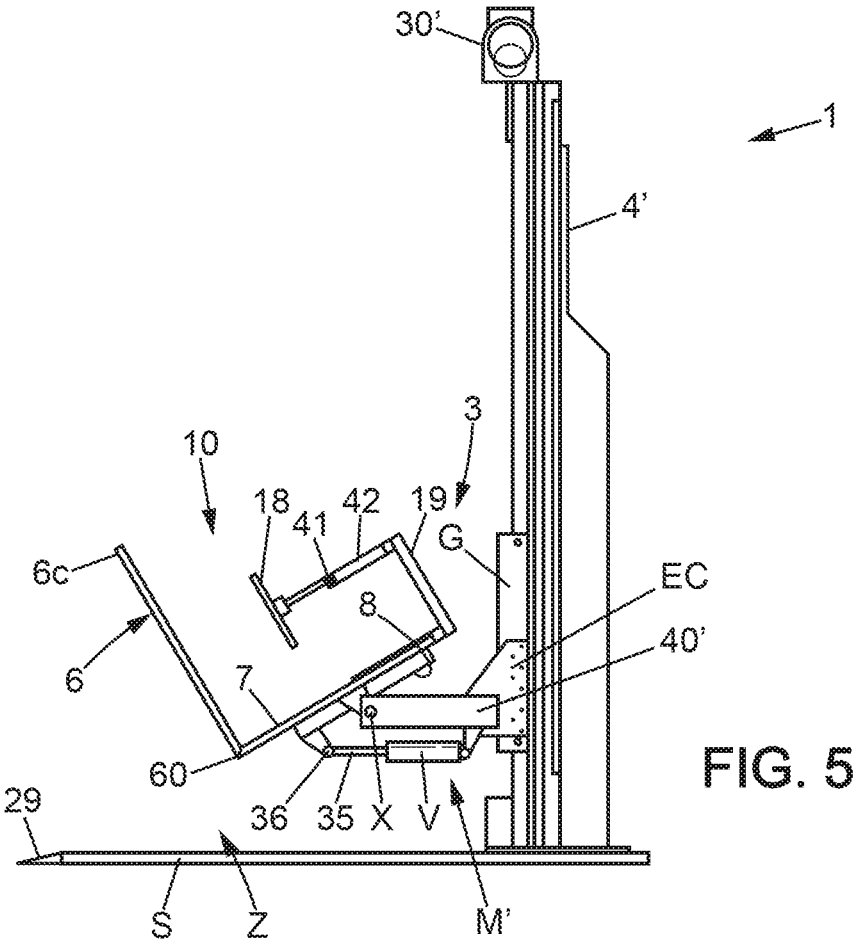
FIG. 5 is a view similar to FIG. 4, showing, in the unloaded state, a handling system according to a second preferred embodiment of the invention, with a single guiding column and a attachment means different for attaching the receiving assembly.

A version of the system with a guide along a typically single guiding column 4' will now be more particularly described, with reference to FIG. 5 and FIG. 6.

The guiding column 4' illustrated in FIG. 5, which is typically less wide than the receiving assembly 10, is here motorized to allow the support device 3 to be lifted on its own. The guiding column 4' shown in FIG. 6 is similar to that of FIG. 5, with two mounts arranged on either side of a jack 51 lifting. It will be understood that the guiding column 4', as clearly visible in FIG. 5 and in FIGS. 6, 7A, and 7B, is close to the rear of the support device 3, being situated on the same side (long side) of the lifting zone Z as the abutment surface 7 in the loading configuration.

The support device 3 comprises a receiving assembly 10 which may be identical or substantially similar to that illustrated in FIG. 1. Column 4' makes it possible to lift a sliding portion EC which has, for example, two opposite flanks G connected to the lifting mechanism. In the case of FIG. 5, there is provided a motor element 30', placed here at the top or near the upper end of the guiding column 4'. By driving, for example via a chain, the sliding portion EC slides vertically between an extreme low position and an extreme high position. The extreme low position may correspond to pressing on an axial stop, so that the sliding portion EC is located further from the ground than the lifting portion 6 (in the loading configuration).

Figure 7A:
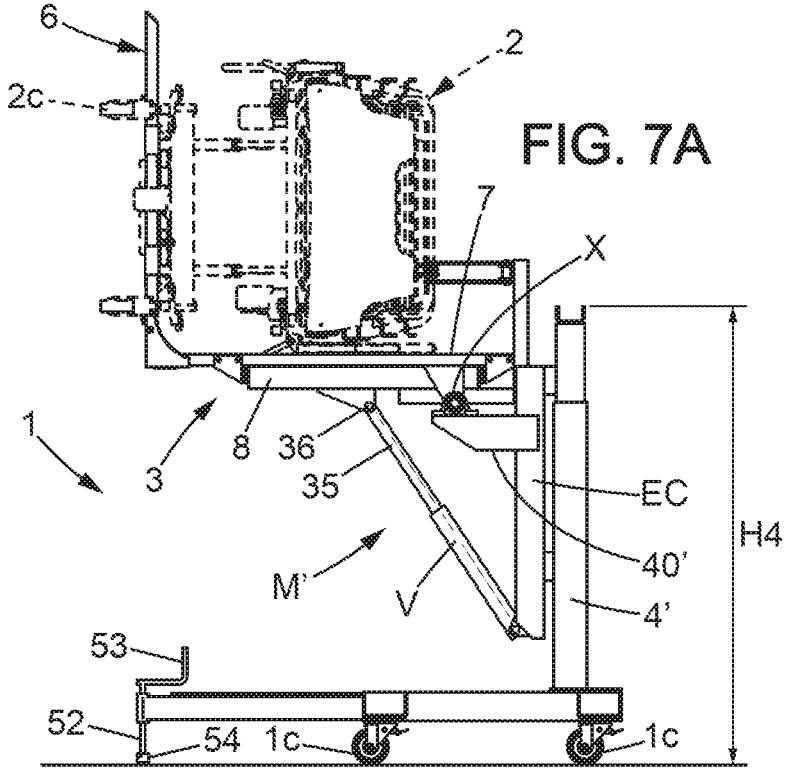
FIGS. 7A and 7B illustrate a side view of the system of FIG. 6 in a maintenance configuration, with respectively two different levels of lifting of the bed unit.
Figure 7B:
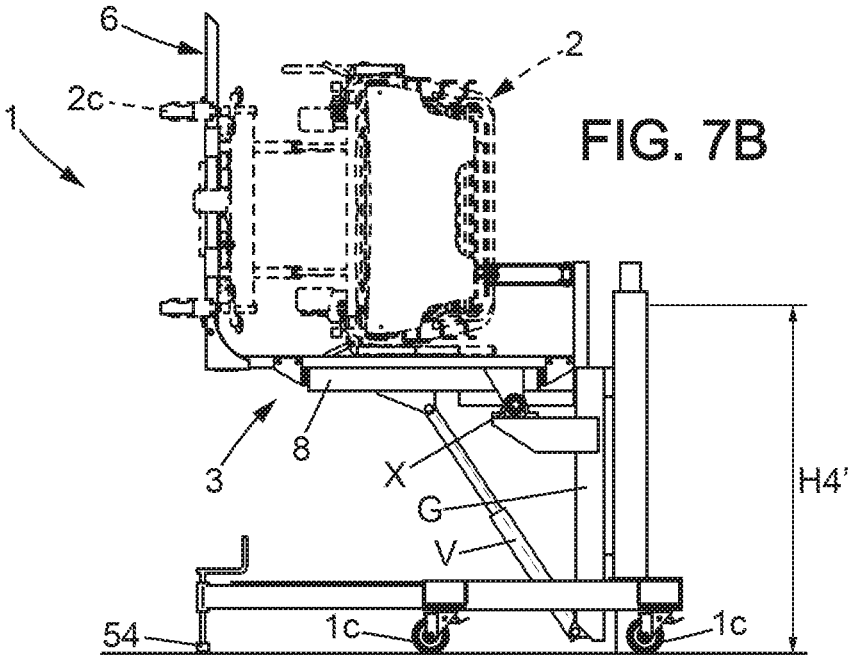

Alternatively, as illustrated in FIGS. 6, 7A and 7B, the lifting jack 51 makes it possible to move the sliding portion EC which moves along two parallel posts of the column 4'.

With reference to FIGS. 5 and 7A, the sliding portion EC defines an attachment zone for at least one connecting member 40'. This connecting member 40', which extends horizontally defining a half-perimeter of the lifting zone, has two arms, optionally connected to the same base. The receiving assembly 10 is disposed between these two arms (only one of the arms being visible in FIG. 5) and these arms can define respective bearings for a pair of rotary shafts formed on the receiving assembly 10. The axis of rotation X is thus horizontally defined by these shafts which belong to an articulated connection, with a substantially constant spacing of this axis X relative to the guiding column 4'.

The articulated connection between the sliding portion EC and the receiving assembly 10 is here achieved in two connection zones separated from each other by the whole receiving assembly 10. In the embodiment in FIG. 5, each arm of the connecting member 40' has a length sufficient for the axis of rotation X to be maintained at a distance (for example between 50 and 120 cm) from the guiding column 4' which allows the receiving assembly 10 to have a clearance. In practice, the volume is optimized using a single guiding column 4' and the handling system 1 is simpler.

The term "column" does not preclude grouping at least two mounts spaced apart by a small distance (much smaller than the length of the receiving assembly 10) and which form a holding and guiding support for a wide enough single sliding portion EC. More generally, it is understood that the structure of the guiding column 4' can take different forms.

A jack V, which preferably extends parallel to one of the arms, is connected by a pivot connection 36 to a frame 8 or another element (distinct from the lifting portion 6) of the receiving assembly 10. Optionally as illustrated in FIG. 5, the pivot connection 36 may be positioned lower than the axis of rotation X when the rod 35 of the cylinder V is in an initial set back position. In this initial recessed position (position not shown), the rod 35 of the jack V holds the receiving assembly 10 in a starting orientation such as that illustrated in FIGS. 1 and 3. The lifting portion 6 is then substantially horizontal. The jack V can be electric or hydraulic.

According to the option shown in FIGS. 7A and 7B, the jack V is angled. This can bring the X axis closer to the column 4' and thus reduce the overall size of the handling system 1.

The human-machine interface makes it possible to modify the position of this rod 35. In a maximum output position, the rod 35 of the jack V pushes a lower portion of the receiving assembly 10, which has the effect of rotating the receiving assembly about the axis of rotation X. The lifting portion 6 is then moved by an angle which may be greater than 45 or 70°, the maximum rotation being approximately 85° or 90°. This is advantageously allowed using a single jack V, here directly placed between the corresponding sliding portion EC and the receiving assembly 10. Of course, the manner of rotating the receiving assembly 10 can be adapted as required and it is understood that this type of connection with a jack is applicable to the case illustrated in FIG. 1. Conversely, a geared motor or the like may be used in an embodiment similar to that of FIG. 5.

More generally, it is understood that the support device 3 can embark second driving means M' to rotate the receiving assembly 10 about the axis of rotation X. When a bed unit 2 is placed with the receiving assembly 10 against the abutment surface 7, it is then possible to orient the determined longitudinal edge 2*a* (which is the edge/side oriented towards the abutment surface 7) downwards in a maintenance configuration. The lifting can be controlled independently of the rotational movement.

For tightening, a jack (not shown) can also be used. This avoids a manipulation operation and prevents a technician to intervene from behind (access that may be less easy because of the presence of the guiding column 4'). The holding element 18 may have a clamping member driven by a rhombus articulated to these tops. The spacing between the pivoting connections 41 located between the lower segments and the upper segments 42 of this rhombus can be adjusted by a jack diagonally placed (horizontally) in this rhombus. Alternatively, any other adjustment member, for example of the sliding rod type, may be used.

One of the advantages of the handling system 1 with a receiving assembly 10 in one piece is that it facilitates the maintenance of heavy bed units 2, including medical beds. Thus, the technician no longer needs to move by himself/herself (by calling on other stakeholders) such a bed unit for a change of wheels, cylinders, engines for lifting the mattress of the bed or any mechanical or electrical part contributing to the bed operation.

The handling system 1 is particularly robust and can lift and rotate a bed that weighs several hundred kilograms. The rotated position avoids having to perform maintenance by placing oneself under the bed (which makes the operation more arduous, wherein one has to raise one's arms and head to repair the defective parts of the bed).

FIGS. 7A and 7B successively illustrate two height levels of the bed unit 2, obtained for the maintenance configuration. In FIG. 7A, the height level is obtained by the direct switching from the loading configuration to the maintenance configuration of the support device 3. In this position of the bed unit 2, the height H3 of the lower casters 2*c* can then be still high, for example greater than 150 cm from the level of the support (ground) on which the handling system 1 rests. In order to facilitate the handling tasks, the position of the support device 3 can be lowered by an appropriate control means of the lifting jack 51 or other mechanical drive member. The height H3' is thus obtained for these same lower casters 2*c*, which is less than the height H3 and can be between 80 and 110 cm for example. The underside of the bed unit 2 can then be perfectly in front of the operator, the height H3' being low enough so that the other higher casters are also accessible (for example to well less than 2 meters from the ground knowing that the width of the bed unit 2, close to the distance between the low casters and the high casters, typically does not exceed 90 cm).

The flexibility of the handling system 1 is such that the receiving assembly 10 can be sized according to the needs and the space available to install the system 1. The latter can be fixed and installed in a workshop of a hospital. The different portions of the handling system 1 are typically removable. For example, receiving assemblies 10 of different size and/or capacity may be assembled on the same lifting and rotating device. The guiding portions 4, 5 can thus be positioned on rails R to adjust the width of the lifting zone Z, as illustrated in FIG. 1. In the case of healthcare beds, it is preferred that the receiving assembly 10 has a length of between 150 (for example for children's beds) and 230 cm.

The handling system 1 is advantageous in that it provides a mode of adjustment of the receiving assembly 10 which allows the technician to work under very favorable ergonomic conditions, being able to adapt in real time the working height to its size (height adjustment being possible after the tilting of the receiving assembly 10 as shown in FIG. 4 or FIG. 5).

It should be obvious to those skilled in the art that the present invention allows embodiments in many other specific forms without departing from the scope of the invention as claimed.

Thus, the term "sliding end" should not be interpreted restrictively and does not necessarily mean that the support device 3 ends laterally with such a sliding portion or end. The term "end" is simply used to signify that a lifting zone Z associated with the device 3 is delimited between two such sliding ends of the support device 3. In an alternative embodiment, the handling system 1 may have, where appropriate, a single support device 3 common to two lifting zones Z separated from each other by an intermediate column. In this case, there are two receiving assemblies 10 formed by the same support device 3 and it can always be considered that the part which slides along the intermediate column corresponds and is functionally identical to a sliding end.

The invention claimed is:

1. A handling system for handling a rolling bed unit, the handling system comprising:

a support device, movable by lifting to lift a bed unit, the support device comprising two sliding ends, two guiding portions separated from one another by a lifting zone and vertically guiding a displacement of the two sliding ends of the support device, and a first driving device for linearly moving at least one of the two sliding ends of the support device and allowing lifting of the support device, wherein the support device comprises:

a lifting portion which extends transversely with respect to the two guiding portions in a loading configuration of a bed unit, the lifting portion extending away from the two guiding portions in the loading configuration, in a central sub-zone of the lifting zone so that the lifting portion extends under a bed unit in said loading configuration, a back part integral with the lifting portion and forming an abutment surface intended to be placed in contact with a determined longitudinal side or edge of the bed unit, the back part and the lifting portion defining a receiving assembly, and at least one holding element adjustable in position to move towards or away from the lifting portion, the receiving assembly being pivotally mounted between the two sliding ends about a horizontal axis of rotation, whereby the handling system has a bed unit maintenance configuration in which the bed unit is raised and held by the support device while having a modified orientation as compared to the loading configuration.

2. The handling system according to claim 1, comprising a second driving device for rotating the receiving assembly about the axis of rotation passing through the two sliding ends, after the support device loaded with the bed unit has been lifted, so as to orient the determined longitudinal side downwards in the bed unit maintenance configuration.

3. The handling system according to claim 2, wherein the second driving device is configured to rotate the receiving assembly up to a maximum of one quarter turn, the rotation angle being configurable by a human-machine interface.

4. The handling system according to claim 2, wherein the receiving assembly is made rotatable by two connection shafts connecting with respectively one and the other of the two sliding ends of the support device, the second driving device comprising a single rotary drive member for defining a first drive shaft among the two connection shafts, the second shaft among the two connection shafts being a following shaft.

5. The handling system according to claim 1, wherein the lifting portion is included in a fork.

6. The handling system according to claim 1, wherein the lifting portion, connected only on one side to the retaining means, comprises two rigid members spaced from another, the spacing of which can be adjusted, each rigid member being provided on top of it with a contact surface made of flexible and/or deformable material.

7. The handling system of claim 1, wherein the lifting portion comprises a fork provided with at least two teeth each elongated from a proximal end to a distal end with respect to the abutment surface, wherein the teeth extend in a direction perpendicular to the axis of rotation.

8. The handling system according to claim 1, comprising a flat base formed between the two guiding portions, the lifting portion extending to a height lower than or equal to 25 cm from the flat base, in a lowered state of the support device which corresponds to the loading configuration.

9. The handling system according to claim 1, wherein the receiving assembly is bent and is in one piece.

10. The handling system according to claim 9, wherein the lifting portion is flat and the holding element comprises a clamping member which, in the loading configuration, is connected from above to the retaining means, the clamping member being movable in a direction perpendicular to the lifting portion and held at a distance from the lifting portion, thereby allowing an outer frame of the lifting bet unit to be inserted from a side opposite to the back part in a clamping zone delimited between the lifting portion and the clamping element.

11. The handling system according to claim 1, further comprising:

at least one sensor for detecting an engaged position of a bed unit against the abutment surface adapted to deliver a corresponding detection information; and a control unit configured to start a lifting of the support device depending on the detection information delivered by said sensor.

12. A handling system for handling rolling bed units, the handling system comprising:

a guiding column adjacent to a lifting zone, and being placed along a given side of the lifting zone, a support device, movable by lifting to lift a bed unit, the support device comprising a sliding portion attached to the guiding column (4') and guided vertically along the the guiding column, and a first driving device for linearly moving the sliding portion of the support device and allowing lifting of the support device, wherein the support device comprises:

a lifting portion that extends transversely with respect to the guiding column in a loading configuration of a bed unit, a back part integral with the lifting portion and forming an abutment surface intended to be engaged by a determined longitudinal side or edge of the bed unit, the back part and the lifting portion defining a receiving assembly, the back part extending on said given side of the lifting zone in the loading configuration, and at least one holding element adjustable in position to move towards or away from the lifting portion, the receiving assembly being pivotally mounted about a horizontal axis of rotation defined by an articulated connection between the sliding portion and the receiving assembly, whereby the handling system has a bed unit maintenance configuration in which the bed unit is raised and held by the support device while having a modified orientation with respect to the loading configuration.

13. The handling system according to claim 12, comprising second driving means for rotating the receiving assembly about the axis of rotation so as to orient the determined longitudinal edge downwards in the bed unit maintenance configuration, the axis of rotation being kept at a constant distance from the guiding column regardless of the height level of the support device.

14. A method for positioning a rolling bed unit, in preparation for a maintenance/repair operation, the method comprising:

placing a bed unit in a lifting zone, above a lifting portion which is part of a support device), the lifting zone being located along a guiding column or between two guiding portions;

engaging a determined longitudinal edge of the bed unit against an abutment surface that is integral with the lifting portion and extends transversely with respect to the lifting portion, so that, in a loading configuration, the bed unit is received in a receiving assembly;

adjusting in position at least one element for holding the bed unit, from above, to obtain a locked relative position between the bed unit and the receiving assembly;

lifting the bed unit by a linear displacement of the support device, with guidance along the guiding column or the two guiding portions; and beyond a predetermined elevation threshold, rotating the receiving assembly and the bed unit held in the locked position about a substantially horizontal axis of rotation, by moving the abutment surface downward to obtain a bed unit maintenance configuration in which the bed unit is raised and held by the support device while having a modified orientation with respect to the loading configuration.

15. The handling system according to claim 1, wherein the holding element is vertically adjustable in position to move towards or away from the lifting portion, in the loading configuration.

16. The handling system according to claim 3, wherein the receiving assembly is made rotatable by two connection shafts connecting with respectively one and the other of the two sliding ends of the support device, the second driving device comprising a single rotary drive member for defining a first drive shaft among the two connection shafts, the second shaft among the two connection shafts being a following shaft.

17. The handling system according to claim 2, wherein the lifting portion is included in a fork.

18. The handling system according to claim 3, wherein the lifting portion is included in a fork.

19. The handling system according to claim 4, wherein the lifting portion is included in a fork.

20. The handling system according to claim 2, comprising a flat base formed between the two guiding portions, the lifting portion extending to a height lower than or equal to 25 cm from the flat base, in a lowered state of the support device which corresponds to the loading configuration.

* * * * *